United States Patent [19]

Koistinen et al.

[11] Patent Number: 4,817,856

[45] Date of Patent: Apr. 4, 1989

[54] METHOD FOR COATING A PUMP IMPELLER

[75] Inventors: Pauli A. T. Koistinen, Joensuu; Seppo T. Tolonen, Outokumpu, both of Finland

[73] Assignee: A. Ahlstrom Corporation, Noormarkku, Finland

[21] Appl. No.: 80,065

[22] Filed: Jul. 31, 1987

Related U.S. Application Data

[63] Continuation-in-part of Ser. No. 788,756, Oct. 18, 1985, abandoned.

[30] Foreign Application Priority Data

Oct. 23, 1984 [FI] Finland ..... 844155

[51] Int. Cl.[4] ..... B23K 31/02

[52] U.S. Cl. ..... 228/176; 228/214; 228/57; 29/23.5; 29/156.8 CF; 29/156.8 FC; 416/241 A

[58] Field of Search ..... 228/119, 176, 199, 203, 228/205, 214, 57; 29/402.18, DIG. 48, 156.8 CF, 156.8 FC, 23.5; 416/241 A; 415/213 R, 213 A; 156/182, 307.3, 278

[56] References Cited

U.S. PATENT DOCUMENTS

| | | | |
|---|---|---|---|
| 2,220,669 | 11/1940 | Allen | 416/241 A |
| 3,155,045 | 11/1964 | Lown et al. | 416/241 A |
| 3,507,581 | 4/1970 | Jensen | 29/156.8 CF |
| 3,541,670 | 11/1970 | McCrory, Jr. | 228/176 |

*Primary Examiner*—Nicholas P. Godici
*Assistant Examiner*—Samuel M. Heinrich
*Attorney, Agent, or Firm*—Dellett, Smith-Hill and Bedell

[57] ABSTRACT

A pump impeller is coated essentially without use of core structures. The pump impeller coating is performed in several stages. Partial units of the impeller are coated, whereafter the coated partial units are assembled together. Exposed areas of the impeller are then coated to provide a continuous coating over the entire impeller.

9 Claims, 2 Drawing Sheets

METHOD FOR COATING A PUMP IMPELLER

CROSS REFERENCE TO RELATED APPLICATION

This is a continuation-in-part of copending U.S. patent application Ser. No. 788,756 filed Oct. 18, 1985, now abandoned.

BACKGROUND OF THE INVENTION

The present invention relates to a method for coating a pump impeller so that the coating process is carried out without need for core structures.

In operation, the pump impeller as well as the pump housing of a pump are subject to various types of strain owing to the material to be pumped. One significant strain is the wear caused by the material. Especially when pumping sludge containing solid substances, the solids contained in the sludge cause substantial wear in the impeller and the pump housing. In order to resist wear, the impeller and the pump housing are generally protected by means of rubber-containing material; apart from protecting the impeller and the pump housing from wear, the rubber-containing material also protects them from corrosion caused by the liquid phase, i.e. water, of the sludge. The coating of the pump housing walls as such does not require special large-scale arrangements, because the pump housing walls are normally straight surfaces, and the wall junctions are formed to be curved surfaces in order to create advantageous flow conditions. The impeller, on the other hand, has a very complex surface and its coating requires special arrangements in order to spread an advantageous, even coating on all surfaces o the impeller, so that the shape of the impeller will be just as favorable hydrodynamically after coating as before.

In the prior art there is known a method for rubberizing a pump impeller, in which method complicated core structures are utilized in order to create an advantageous, even rubber coating. According to this previously known method, the ready-welded impeller frame, which is made of steel and comprises the impeller hub, the two side plates and the blade supports, is in the first stage placed within the coating mold suspended by special guides located in the mold. Thereafter the mold is filled with a sufficient amount of rubber and pressed, so that any excess rubber is squeezed out during the pressing. Consequently, the mold must have a solid structure in order to withstand the fairly high working pressure required in the rubberizing and the fairly high temperature caused by the molten rubber. In addition to the above factors, the structure of the mold becomes even more complicated owing to the steam channels which are necessary because the rubberizing process requires an essentially even temperature.

Although the above described, previously known rubberizing method aims at creating a coating as even as possible in order to fulfill the hydrodynamic requirements, the various stages of the process proceed, however, mainly according to the conditions set by the coating technique, and the hydrodynamic aspects receive less attention. Furthermore, because the mold must support the impeller, the mold is generally manufactured by machining from a solid block of material, and its manufacturing expenses are therefore high. Moreover, the currently used mold technique is not suited for serial production, but each impeller must be rubberized separately all through the process.

The present invention may be used to eliminate some of the drawbacks of the prior art and to achieve a better and simpler method for coating a pump impeller, so that the mold employed in the coating process is suited for serial production, and costly and complicated core structures are unnecessary.

SUMMARY OF THE INVENTION

According to the invention, the coating of a pump impeller is carried out in several stages so that the impeller parts are first coated either partially joined or separately whereafter the different parts are assembled for instance by means of assembly welding; opposing areas of the impeller are then coated to provide a continuous coating over substantially the entire impeller.

Owing to differences in impeller structures—for instance the location of the impeller division surface can vary with respect to the impeller blades—it is advantageous to assemble the separate parts of the impeller into various partial units before assembly, and before the coating the junction surfaces left between the partial units after assembly. Thus the hydrodynamic characteristics of the impeller will also be taken into account during the coating process.

The method of the present invention is advantageously suited for coating with synthetic rubber. Furthermore, because the coating is applied only for simple partial units or single parts, the employed molds can be substantially simpler than those used in prior art impeller-coating methods. The manufacturing costs and total prices of these simple molds are substantially lower than those of the complex mold of the prior art. Now the coating process itself is also simplified, and the regulation of the parameters which have significant effects on the final product, such as temperature and material feed, can be accomplished in a remarkably easy and accurate manner.

When applying the method of the invention for coating a pump impeller, the simple molds employed therein can also be utilized for coating several impellers in succession. Furthermore, when applying the method of the invention, the final product, i.e. the pump impeller, can be continuously developed and improved in an inexpensive way and changes in the structure thereof are easily carried out, because frequently they entail modifying only a small part of the impeller, and not replacing all of the molds with new ones.

BRIEF DESCRIPTION OF THE DRAWINGS

In the following the invention is explained with reference to the appended drawings in which.

DETAILED DESCRIPTION

Figure 1:
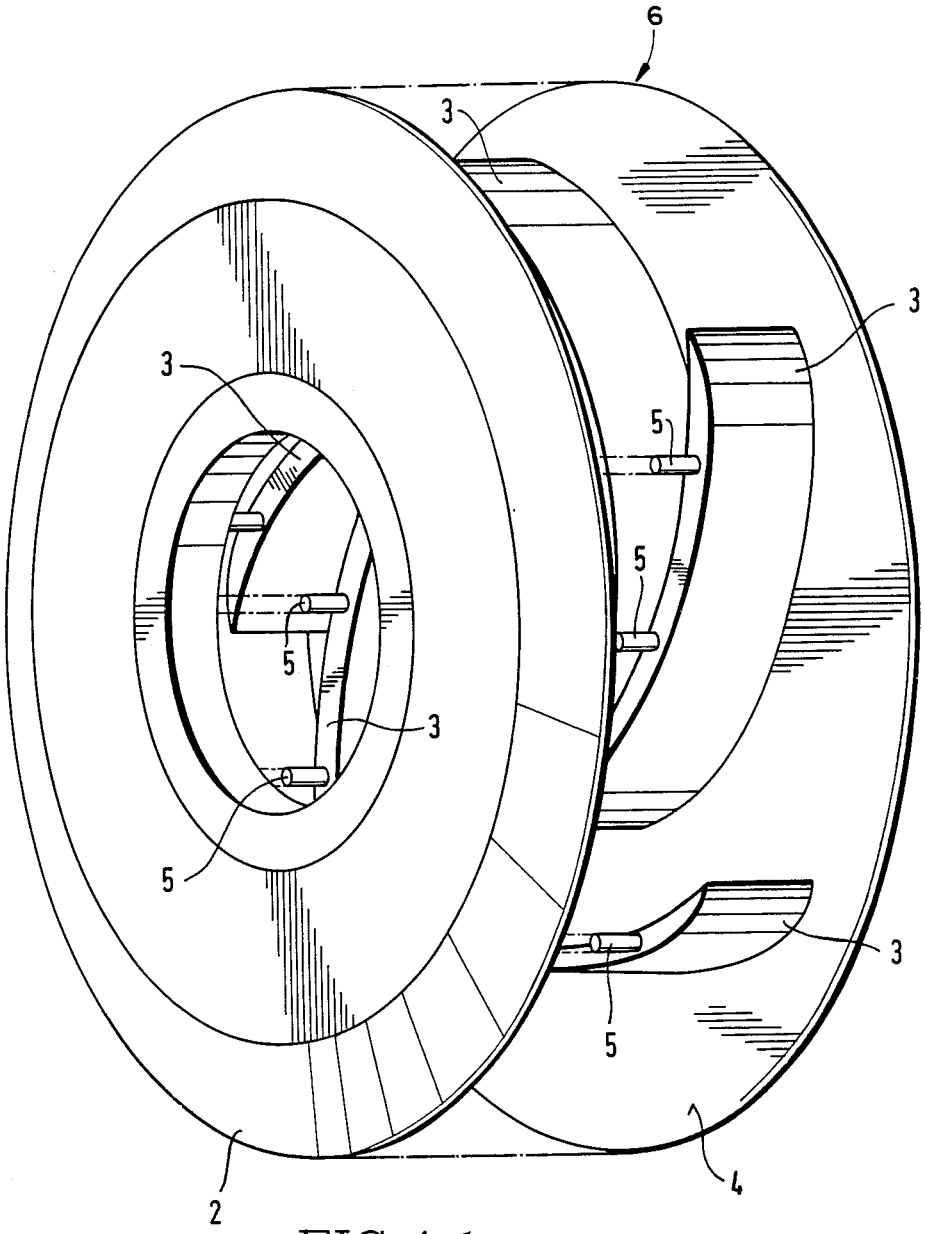
FIG. 1 is an axonometrical illustration of the impeller of a pump before assembling the partial units according to the method of the invention, FIGS. 2(*a*)–2(*c*) are partial sectional views of the impeller shown in FIG. 1, and FIGS. 3(*a*) and 3(*b*) are partial sectional views of the impeller taken perpendicular to FIGS. 2(*a*)–2(*d*).
Figure 2A:
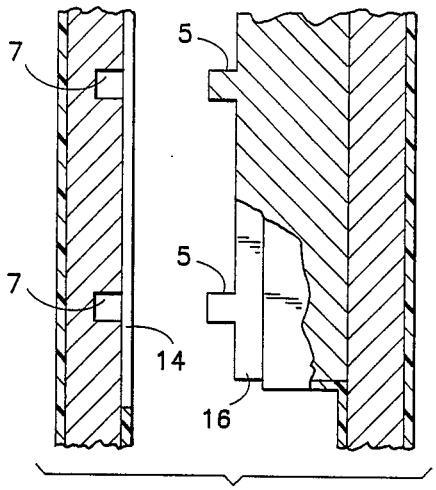
Figure 2B:
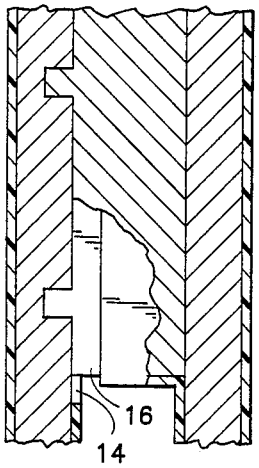
Figure 2C:
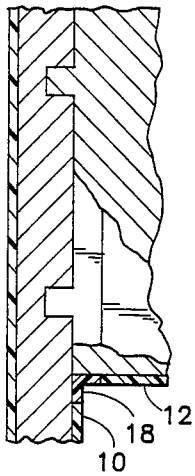
Figure 3A:
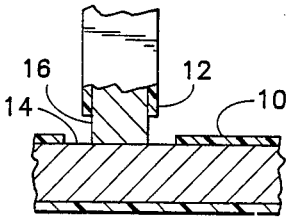
Figure 3B:
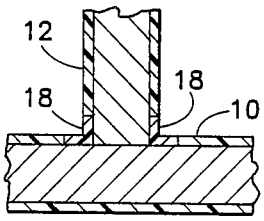

The impeller shown in FIG. 1 is composed of a suction-side plate 2, blades 3, a hub-side plate 4 and blade supports 5. A hub (not shown) is attached to the hub-side plate 4 for mounting the impeller. The impeller is made up of two partial units which are assembled to form the complete impeller. One partial unit comprises only the suction-side plate 2. The plate 2 has a coating 10 of synthetic rubber. The other partial unit 6 comprises the hub-side plate 4, the blades 3 and the blade supports 5. The partial unit 6 is assembled, and the partial unit 6 is provided with a coating 12 of synthetic rubber. The molds that are used to apply the coatings 10 and 12 are configured so that selected areas of the partial units 2 and 6, particularly the areas where the units meet, remain exposed as shown at 14 and 16 in FIGS. 2 and 3. The material of the coatings 10 and 12 is partly cured. The two partial units 2 and 6 are then fitted together so that the blade supports 5 enter bores 7 in the plate 2, and the partial units are secured by plug welding. Because the partial units are exposed at the areas where they meet, the coatings 10 and 12 do not interfere with fitting of the partial units together or with the welding operation. In order to prevent damage to the impeller by contact with water and abrasive materials, the coating is completed by applying additional synthetic rubber 18 o that it bonds adhesively to the coatings 10 and 12 and a continuous coating is formed over the entire impeller. The exterior surface of the coating material 16 may be brought to a desired configuration by machining so as to remove excess coating material after the material 18 is cured. Alternatively, excess coating material may be removed while it is still in the plastic state and the cure completed thereafter. In either case, a hydrodynamically advantageous coating surface is provided.

It will be appreciated that the present invention is not restricted to the particular embodiments that have been described, and that variations may be made therein without departing with the scope of the invention as defined in the appended claims and equivalents thereof.

We claim:

1. A method for forming a coated pump impeller from at least two parts which can be fitted together, comprising (a) coating said parts with a desired coating material except in the areas where they meet when they are fitted together, (b) fitting the coated parts together in order to form an impeller, and (c) applying coating material in an uncured state to exposed areas of the parts in order to form an essentially continuous coating where the parts meet.

2. A method according to claim 1, wherein at least one of said parts is formed from at least two component units and the method comprises securing said component units together and subsequently coating said one part with the coating material applied in step (a).

3. A method according to claim 1, wherein the coated parts of the impeller are secured together in step (b) by welding.

4. A method according to claim 1, wherein the coating material is a curable synthetic rubber and step (a) comprises partially curing the coating material applied in step (a) before carrying out step (b), and completing the cure of the coating material applied in step (a) after step (b) has been carried out.

5. A method according to claim 4, further comprising partially curing coating material applied in step (c), selectively removing coating material applied in step (c) while it is in the partially-cured state, and completing the cure of material applied in step (c).

6. A method according to claim 4, further comprising completing the cure of material applied in step (c) and then selectively removing material applied in step (c).

7. A method according to claim 1, wherein the coating material is a synthetic rubber.

8. A method according to claim 1, further comprising:

(d) curing the coating material applied in step (c).

9. A method for forming a coated pump impeller from at least two parts which can be fitted together, comprising (a) coating the parts with a curable synthetic rubber except in areas where the parts meet when they are fitted together, (b) at least partially curing the curable synthetic rubber applied in step (b), (c) fitting the coated parts together in order to form an impeller, (d) applying said curable synthetic rubber in an uncured state to exposed areas of the parts in order to form an essentially continuous coating where the parts meet, and (e) curing all of the curable synthetic rubber that has not previously been completely cured.

* * * * *